US008863726B2

(12) United States Patent
Ruggiero et al.

(10) Patent No.: US 8,863,726 B2
(45) Date of Patent: Oct. 21, 2014

(54) METHOD AND SYSTEM FOR ENGINE CYLINDER DECOMPRESSION

(71) Applicant: Jacobs Vehicle Systems, Inc., Bloomfield, CT (US)

(72) Inventors: Brian Ruggiero, East Granby, CT (US); Steven N. Ernest, Windsor, CT (US); Neil E. Fuchs, New Hartford, CT (US); Jin Xu, Andover, MA (US); Eric Day, Longmeadow, MA (US); Joseph Paturzo, Avon, CT (US); Johnathan W. Prusak, West Hartford, CT (US); Jeffrey E. Mossberg, Windsor, CT (US)

(73) Assignee: Jacobs Vehicle Systems, Inc., Bloomfield, CT (US)

( * ) Notice: Subject to any disclaimer, the term of this patent is extended or adjusted under 35 U.S.C. 154(b) by 0 days.

(21) Appl. No.: 13/624,478

(22) Filed: Sep. 21, 2012

(65) Prior Publication Data

US 2013/0068195 A1 Mar. 21, 2013

Related U.S. Application Data

(60) Provisional application No. 61/537,430, filed on Sep. 21, 2011.

(51) Int. Cl.

| | |
|---|---|
| ***F01L 13/08*** | (2006.01) |
| ***F02D 13/04*** | (2006.01) |
| ***F01L 13/06*** | (2006.01) |
| *F01L 1/26* | (2006.01) |

(52) U.S. Cl.

CPC ..... *F02D 13/04* (2013.01); *F01L 2820/01* (2013.01); *F01L 2800/01* (2013.01); *F01L 13/06* (2013.01); *F01L 1/267* (2013.01); *F01L 13/065* (2013.01); *F01L 13/08* (2013.01)

USPC ..... 123/321; 123/90.12; 123/90.16; 123/182.1

(58) Field of Classification Search

CPC ..... F01L 13/08; F01L 13/085; F02N 19/004

USPC ..... 123/90.12, 90.15, 90.16, 182.1, 321, 123/179.4, 198 DB, 198 DC

See application file for complete search history.

(56) References Cited

U.S. PATENT DOCUMENTS

| | | | | |
|---|---|---|---|---|
| 3,220,392 | A | 11/1965 | Cummins | |
| 4,543,927 | A * | 10/1985 | Luhn et al. | 123/182.1 |
| 5,586,533 | A | 12/1996 | Feucht | |
| 5,632,238 | A * | 5/1997 | Furukawa et al. | 123/179.3 |
| 5,816,216 | A | 10/1998 | Egashira et al. | |
| 6,273,057 | B1 | 8/2001 | Schwoerer et al. | |
| 6,450,144 | B2 * | 9/2002 | Janak et al. | 123/321 |

(Continued)

*Primary Examiner* — Erick Solis

(74) *Attorney, Agent, or Firm* — Vedder Price PC

(57) ABSTRACT

A system for actuating an engine valve to decompress an engine cylinder for engine start up and/or engine braking is disclosed. The system may include a first member, such as an outer piston, disposed above an engine valve, which receives an inner piston extending into a bore provided in the first member. One or more springs may bias the inner piston into a predefined position in the first member. The inner piston may include a lower surface that directly, or through an intervening sliding pin, actuates an engine valve in response to the application of fluid pressure on the inner piston. The inner piston may be used to decompress an engine cylinder for engine start up and/or to provide engine braking.

27 Claims, 9 Drawing Sheets

(56) References Cited

U.S. PATENT DOCUMENTS

| | | | | |
|---|---|---|---|---|
| 6,594,996 | B2 | 7/2003 | Yang | |
| 6,883,492 | B2 * | 4/2005 | Vanderpoel et al. | 123/321 |
| 6,988,471 | B2 | 1/2006 | Chang | |
| 7,059,282 | B2 | 6/2006 | Vorih et al. | |
| 7,234,435 | B2 * | 6/2007 | Lewis et al. | 123/198 F |
| 7,392,772 | B2 | 7/2008 | Janak et al. | |
| 7,984,705 | B2 | 7/2011 | Yang | |
| 8,225,769 | B2 * | 7/2012 | Dilly | 123/321 |
| 8,240,288 | B2 * | 8/2012 | Dilly | 123/321 |
| 8,434,451 | B2 * | 5/2013 | Yoon et al. | 123/321 |
| 8,499,740 | B2 * | 8/2013 | Yoon et al. | 123/321 |
| 2005/0000499 | A1 * | 1/2005 | Ruggiero et al. | 123/568.14 |
| 2005/0252484 | A1 * | 11/2005 | Vanderpoel et al. | 123/321 |
| 2006/0081213 | A1 * | 4/2006 | Yang et al. | 123/321 |
| 2007/0084653 | A1 * | 4/2007 | Hughes et al. | 180/65.3 |
| 2010/0037854 | A1 * | 2/2010 | Yang | 123/321 |
| 2010/0170472 | A1 | 7/2010 | Yang | |
| 2012/0186546 | A1 | 7/2012 | Cecur et al. | |

* cited by examiner

METHOD AND SYSTEM FOR ENGINE CYLINDER DECOMPRESSION

CROSS-REFERENCE TO RELATED APPLICATIONS

The present application relates to, and claims the priority of, U.S. Provisional Patent Application Ser. No. 61/537,430 filed Sep. 21, 2011, which is entitled "Method and System For Engine Cylinder Decompression".

FIELD OF THE INVENTION

The present invention relates to systems for, and methods of actuating engine valves to decompress an engine cylinder for engine start-up, bleeder braking and/or compression release braking.

BACKGROUND OF THE INVENTION

Flow control of exhaust gas through an internal combustion engine has been used in order to provide vehicle engine braking of both the compression-release type and the bleeder type. Both types of engine braking operate by decompressing an engine cylinder to allow exhaust gas to exit the cylinder. Control of the flow of exhaust gas may also provide benefits during engine start-up. Specifically, holding open an exhaust valve during engine start-up may decompress the cylinder so that the piston may move towards a cylinder top dead center (TDC) position more easily. Benefits from decompression during engine start-up may include easier engine starting, lighter starting system and/or battery requirements, and avoidance or reduction in the need for additional starting aids.

Generally, engine braking systems may control the flow of exhaust gas from the engine cylinders to the exhaust system (i.e., exhaust manifold, tail pipe, etc.). The flow of exhaust gas from the engine cylinders may be controlled to provide a retarding force on the engine pistons to slow the engine. Specifically, one or more exhaust valves may be selectively actuated to provide compression-release, bleeder, and/or partial bleeder engine braking.

The operation of a compression-release type engine brake, or retarder, is well known. A four-stroke internal combustion engine experiences intake, compression, expansion, and exhaust cycles during its operation. The intake cycle occurs in conjunction with a main intake valve event, during which the intake valves in each cylinder are opened to allow air to enter the cylinder. The exhaust cycle occurs in conjunction with a main exhaust valve event, during which the exhaust valves in each cylinder are opened to allow combustion gases to exit the cylinder. Typically, the exhaust and intake valves are closed during much of the compression and expansion cycles. During compression-release engine braking, fuel supply to the engine cylinders is ceased and, in addition to the main exhaust valve event, one or more exhaust valves also may be selectively opened during the compression stroke to convert the internal combustion engine into a power absorbing air compressor. Specifically, as an engine piston travels upward during the compression stroke, the gases trapped in the cylinder are compressed and oppose the upward motion of the piston. As the piston approaches the top dead center (TDC) position during the compression stroke at least one exhaust valve may be opened to release the compressed gases in the cylinder to the exhaust manifold, preventing the energy stored in the compressed gases from being returned to the piston on the subsequent expansion down-stroke. In doing so, the engine develops retarding power to help slow the vehicle down. An example of a prior art compression release engine brake is provided by the disclosure of Cummins, U.S. Pat. No. 3,220,392 (November 1965), which is hereby incorporated by reference.

The operation of a bleeder type engine brake is also known. During bleeder engine braking, in addition to the main exhaust valve event, one or more exhaust valve(s) may be held slightly open throughout the remaining engine cycles (i.e., the intake, compression, and expansion cycles for a full-cycle bleeder brake) or during a portion of the remaining engine cycles (i.e., the compression and expansion cycles for a partial-cycle bleeder brake). The primary difference between a partial-cycle bleeder brake and a full-cycle bleeder brake is that the former may permit the exhaust valve to close during most or all of the intake cycle. An example of a bleeder engine brake is disclosed in Yang, U.S. Pat. No. 6,594,996 (Jul. 22, 2003), which is hereby incorporated by reference.

The initial opening of the exhaust valves in a bleeder braking operation may be in advance of TDC of the compression stroke, and is preferably near a bottom dead center (BDC) point between the intake and compression cycles. As such, a bleeder type engine brake may require much lower force to actuate the valves, and generate less noise due to continuous bleeding instead of the rapid blow-down of a compression-release type brake. Thus, an engine bleeder brake can have significant advantages.

An engine decompression system may hold open one or more exhaust valves in an engine cylinder during the start-up of the engine. An engine decompression system of the type described herein may be particularly useful in cold weather conditions, when cranking battery power is lower, cranking time to start-up is increased, and the engine is more difficult to turn over. In addition, engine decompression, which may reduce battery power and starter system requirements, may result in lower weight components, which permit increased fuel efficiency. Reduction in start up time resulting from use of a decompression system may also provide emissions benefits. Accordingly, advantages such as these, but not limited to the foregoing, may be realized by use of one or more of the embodiments of the invention described herein.

Additional advantages of various embodiments of the invention are set forth, in part, in the description that follows and, in part, will be apparent to one of ordinary skill in the art from the description and/or from the practice of the invention.

SUMMARY OF THE INVENTION

Responsive to the foregoing challenges, Applicant has developed an innovative system for actuating an engine valve to decompress an engine cylinder or provide engine bleeder braking comprising: a vertically moveable member disposed above an engine valve, said vertically moveable member having an inner piston bore extending horizontally into the vertically moveable member; a horizontally moveable inner piston disposed in the inner piston bore; a first spring provided in the inner piston bore, said first spring biasing the inner piston into a predefined position in the inner piston bore; and a hydraulic or pneumatic fluid supply passage communicating with the inner piston bore, wherein said inner piston includes a means for causing an engine valve to be actuated provided along the inner piston lower surface.

Applicants have further developed an innovative system for actuating an engine valve to decompress an engine cylinder or provide engine bleeder braking comprising: housing mounted in an engine above one side of a valve bridge; a piston bore extending horizontally into the housing; a hydraulic fluid supply passage communicating with the piston bore;

an actuator piston disposed in the piston bore, said actuator piston having an interior chamber with an end wall; a spring biasing the actuator piston into the piston bore in a direction which causes the actuator piston to engage an underlying engine valve bridge; a sleeve disposed in the interior chamber; and a spring biasing the sleeve away from the interior chamber end wall.

It is to be understood that both the foregoing general description and the following detailed description are exemplary and explanatory only, and are not restrictive of the invention as claimed.

BRIEF DESCRIPTION OF THE DRAWINGS

In order to assist the understanding of this invention, reference will now be made to the appended drawings, in which like reference characters refer to like elements.

DETAILED DESCRIPTION OF EMBODIMENTS OF THE INVENTION

Figure 1:
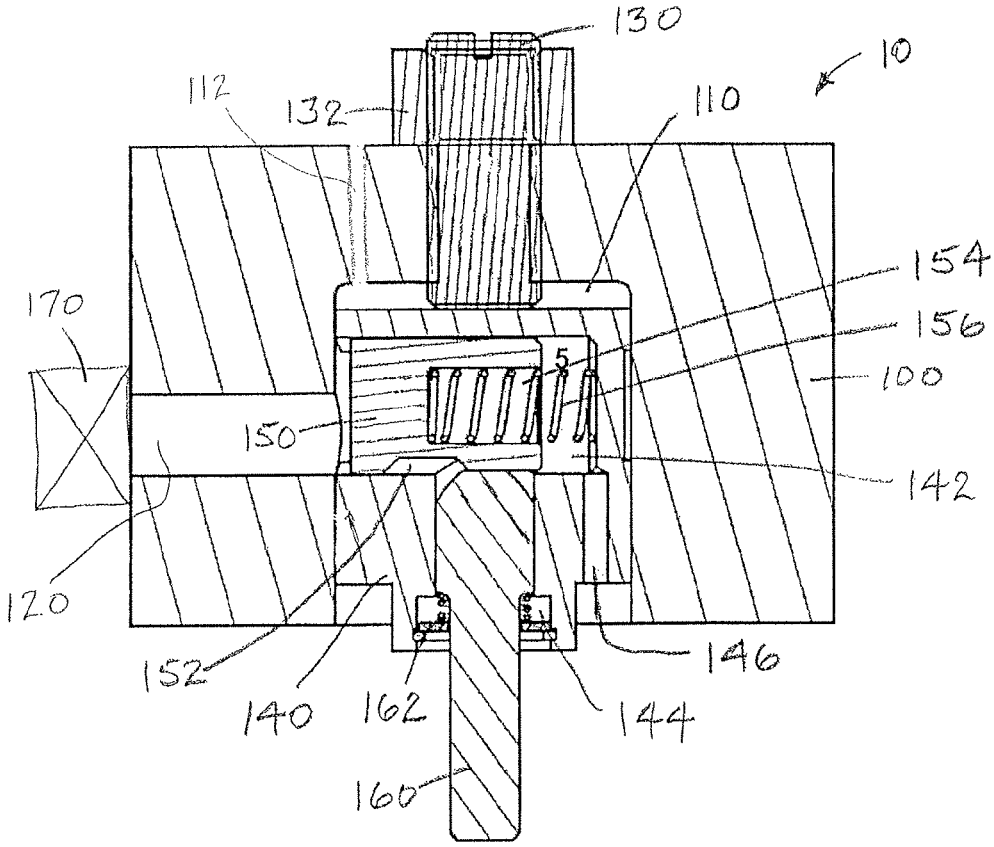
FIG. 1 is a side view in cross-section illustrating a system for providing engine braking and/or engine decompression for engine start-up in accordance with a first embodiment of the present invention.

Reference will now be made in detail to a first embodiment of the present invention, an example of which is illustrated as the engine valve actuation system 10 in FIG. 1 of the accompanying drawings. The valve actuation system 10 may include a housing 100 mounted in an engine above a rocker arm, valve bridge, engine poppet valve, or other valve train element (not shown). The housing 100 may include a vertically extending outer piston bore 110 and a hydraulic fluid supply passage 120 communicating with the outer piston bore. A lash adjusting screw 130 may extend vertically through the housing 100 into the outer piston bore 110. A nut 132 may be used to lock the lash adjusting screw in place. An optional vent passage 112 may extend from the outer piston bore 110 to an ambient.

An outer piston 140 may be disposed in the outer piston bore 110 to be vertically moveable. "Vertically moveable" is defined by movement of the outer piston 140 along the axis of the outer piston bore 110. The outer piston 140 may include an inner piston bore 142 which extends laterally or horizontally into the outer piston and registers with the fluid supply passage 120. The outer piston 140 acts as a vertically moveable member or "housing" itself for the horizontally disposed inner piston provided in the inner piston bore. The outer piston 140 may also include a pin bore 144 extending vertically from the bottom of the outer piston 140 to the inner piston bore 142. A vent passage 146, spaced laterally from the pin bore 144, may also extend from the bottom of the outer piston 140 to the inner piston bore 142. The upper surface of the outer piston 140 may contact the lash adjusting screw 130.

An inner piston 150 may be horizontally disposed in the inner piston bore 142. The inner piston 150 may include an annular recess 152 which extends partially (shown) or completely (not shown) around the circumference of the inner piston. The recessed surface formed by the recess 152 may define one or more shoulders which frame the recess. The inner piston 150 may further include an interior bore 154 which receives an inner piston spring 156. The spring 156 may bias the inner piston 150 towards the fluid supply passage 120. The recess 152 formed in the inner piston 150 may be positioned along the lateral length of the inner piston so that it is not centered above the pin bore 144 when the inner piston is closest to the fluid supply passage 120.

A vertically sliding pin 160 may be disposed in the pin bore 144. The sliding pin 160 may have an upper portion with a chamfered upper surface, and a reduced diameter lower portion. A pin shoulder may be formed at the intersection of the reduced diameter lower portion and the upper portion of the sliding pin 160. A pin spring 162 may be provided between the sliding pin 160 shoulder and a washer through which the reduced diameter lower portion of the sliding pin extends. The chamfered upper surface of the sliding pin may be shaped and sized to be received within the annular recess 152. The sliding pin 160 may be positioned above a rocker arm or valve bridge, which in turn is used to actuate an exhaust valve. If positioned above a valve bridge, the sliding pin 160 may be positioned above the center of the valve bridge to open multiple exhaust valves, or above one end of a floating valve bridge to open a single exhaust valve.

Figure 13:
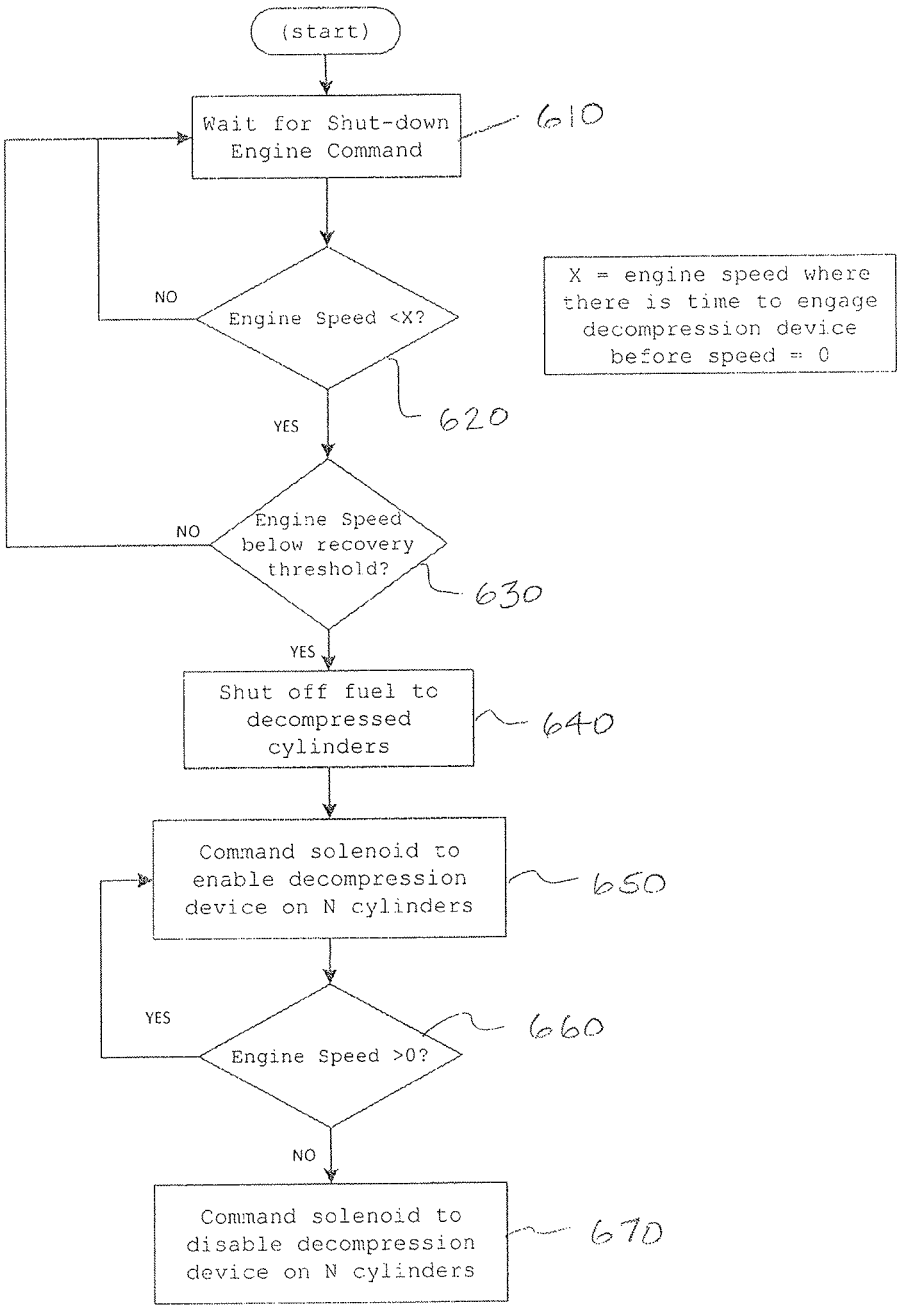
FIG. 13 is a flow chart illustrating an example of a process for decompressing engine cylinders at engine shut off in accordance with an embodiment of the present invention.

The embodiment shown in FIG. 1 may provide cylinder decompression during engine start-up by holding open one or more exhaust valves (not shown) through vertical movement of the sliding pin 160 after engine shut off. With reference to FIGS. 1 and 13, when the engine is shut off, a shut down command is received during step 610, after which the engine speed is determined to ascertain whether it is below a threshold value X in step 620. If the engine speed is not below the threshold X, the system may continue to monitor engine speed until it is determined to be below the threshold. Once the engine speed is determined to be below the threshold X, the engine speed may be compared with a recovery threshold in step 630. If the engine speed is not below the recovery threshold, the system may return to step 610, however, if engine speed is below the recovery threshold, fuel may be shut off to the cylinders to be decompressed in step 640. Thereafter, the control valve 170 (FIG. 1), may be instructed to open in step 650, causing hydraulic or pneumatic pressure to be decreased in the fluid supply passage 120. As a result, the inner piston 150 may be translated horizontally towards the fluid supply passage under the influence of the inner piston spring 156. Horizontal movement of the inner piston 150 means movement of the inner piston along the inner piston bore 142. As the inner piston 150 moves toward the left (as shown in FIG. 1), the sliding pin 160 is forced downward so that it is, for example, flush with the wall of the inner piston bore 142. The translation of the sliding pin 160 downward causes it to move the rocker arm or valve bridge below it downward, which in turn will prevent the exhaust valve from closing, via direct contact or through a valve bridge, after being opened by another valve train element such as a rocker arm. Thus, the lower surface of the inner piston 150 provides a means for causing the exhaust valve to be actuated using the sliding pin 160. Preferably, this downward translation may be about 2 mm for decompression at start-up, however the invention is not limited by the amount of downward translation. In step 660, engine speed may be checked to determine if it is above zero. If engine speed is above zero, the control valve may be maintained open. If engine speed is determined to be zero, the control valve may be instructed to close in step 670. The inner piston 150 and the sliding pin 160 remain in the position shown in FIG. 1 while the engine is off. As a result, one or more exhaust valves are open at the time engine start-up is next attempted.

Figure 14:
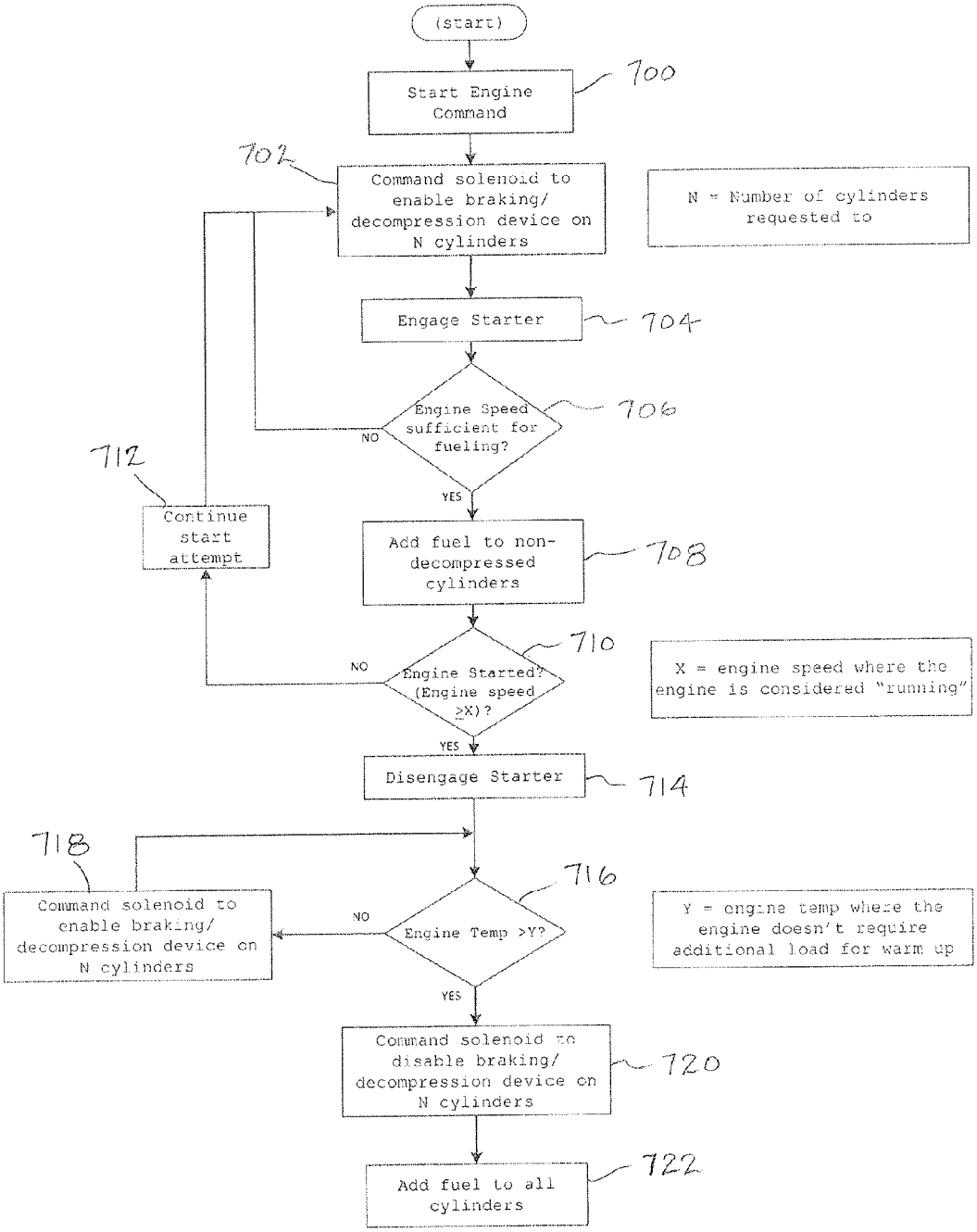
FIG. 14 is a flow chart illustrating an example of a process for starting an engine with decompressed engine cylinders in accordance with an embodiment of the present invention.

With reference to FIGS. 1 and 14, the engine may be started as follows. The system 10 may receive a command that engine starting is commencing in step 700 at which time fluid is not initially provided to the fluid supply passage 120 because the control valve 170 is closed and/or the fluid source is inactive. In turn, the fluid control valve 170 may remain closed at step 702, and the engine starter may be instructed to turn over the engine in step 704. In step 706, engine speed may be checked to determine if it is sufficient for fueling the non-decompressed engine cylinders. If engine speed is not sufficient, the engine start attempt may be continued by keeping the control valve 170 closed. If engine speed is sufficient for fueling, fuel may be added to the non-decompressed cylinders in step 708. When engine speed equals or exceeds a predetermined threshold, as determined in step 710, the starter may be disengaged in step 714. If the engine is not yet started, the start attempt may be continued per step 712. Thereafter, the engine temperature may be monitored to determine if it is above a threshold value Y in step 716. If the temperature threshold Y is not surpassed, the control valve 170 may be maintained closed per step 718. If the temperature threshold Y is surpassed, the control valve 170 may be commanded to open in step 720 and fuel supplied to all engine cylinders in step 722.

After the control valve 170 is opened in step 720, it may take until near the time or after the engine is running for sufficient fluid pressure to build in the fluid supply passage 120 to move the inner piston 150 into the inner piston bore 142 against the bias of the inner piston spring 156. The lateral or horizontal movement of the inner piston 150 into its bore 142 causes the annular recess 152 to register with the upper portion of the sliding pin 160. When the inner piston 150 is moved fully to the right, the upper portion of the sliding pin 160 is received within the annular recess 152, and as a result, the sliding pin translates upward under the influence of the pin spring 162. In turn, the sliding pin no longer is capable of holding the rocker arm or valve bridge down to keep the exhaust valve(s) open. Thereafter, the exhaust valves may be opened and closed under the influence of other valve train elements.

The embodiment shown in FIG. 1 may also provide bleeder type engine braking during engine operation by holding open one or more exhaust valves through vertical movement of the sliding pin 160. In order to provide engine braking, the fluid supply passage 120 is connected to an optional solenoid or other type of control valve 170 which can selectively maintain or vent hydraulic or pneumatic pressure from the fluid supply passage in response to an electrical signal. When engine braking is desired during engine operation, fuel flow to the engine cylinder ceases and hydraulic pressure is decreased in the fluid supply passage 120 under the control of the control valve 170. The control valve 170 may decrease hydraulic pressure by venting hydraulic fluid from the fluid supply passage 120. As a result, the inner piston 150 is translated towards the fluid supply passage under the influence of the inner piston spring 156, the sliding pin 160 is forced downward the so that it is flush with the wall of the inner piston bore 142, and the rocker arm or valve bridge below the sliding pin cracks open one or more exhaust valves. Preferably, this downward translation of the exhaust valve may be about 0.5 mm for engine braking, however the invention is not limited by the amount of downward translation of the exhaust valve. The inner piston 150 and the sliding pin 160 may remain in the position shown in FIG. 1 while hydraulic fluid pressure is applied to the inner piston bore 142 by the fluid supply passage 120. As a result, one or more exhaust valves are maintained open to provide bleeder braking.

When engine braking is no longer desired, the control valve 170 may be activated to supply hydraulic pressure to the fluid supply passage 120. As hydraulic pressure builds in the fluid supply passage 120, the inner piston 150 is forced into the inner piston bore 142 against the bias of the inner piston spring 156. The lateral movement of the inner piston 150 into its bore 142 causes the annular recess 152 to register with the upper portion of the sliding pin 160. When the inner piston 150 is moved fully to the right, the upper portion of the sliding pin 160 is received within the annular recess 152, and as a result, the sliding pin translates upward under the influence of the pin spring 162. In turn, the sliding pin 160 no longer holds the rocker arm or valve bridge down to keep the exhaust valve(s) open and bleeder braking ceases.

Figure 2:
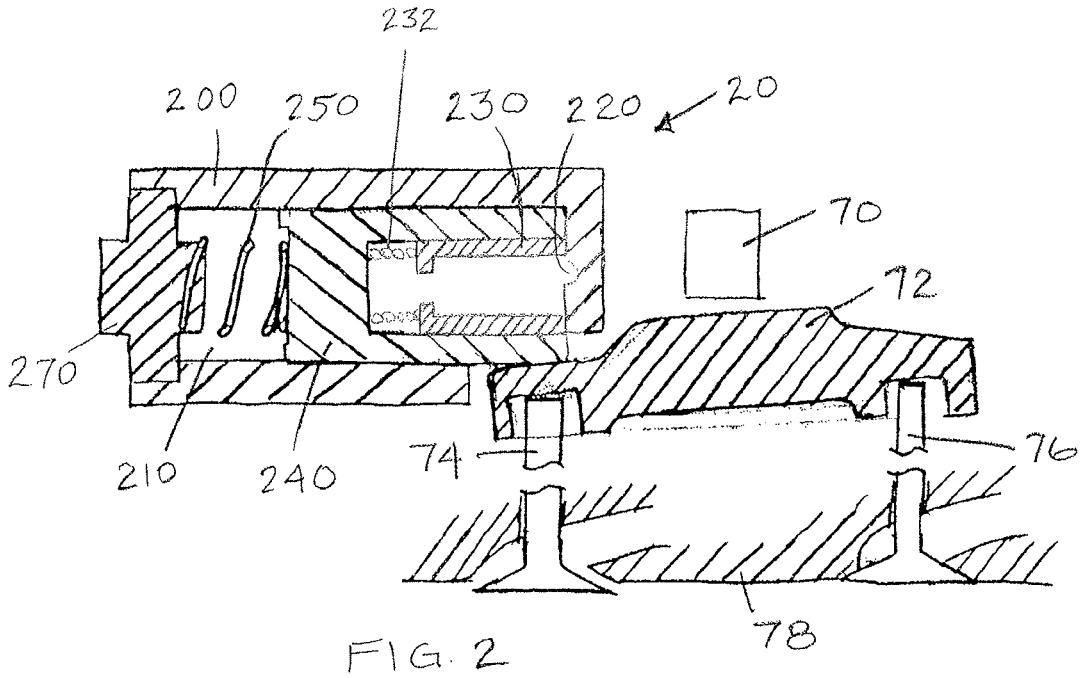
FIG. 2 is a side view in cross-section illustrating a system for providing engine braking and/or engine decompression for engine start-up in accordance with a second embodiment of the present invention when the system is holding an engine valve open.
Figure 3:
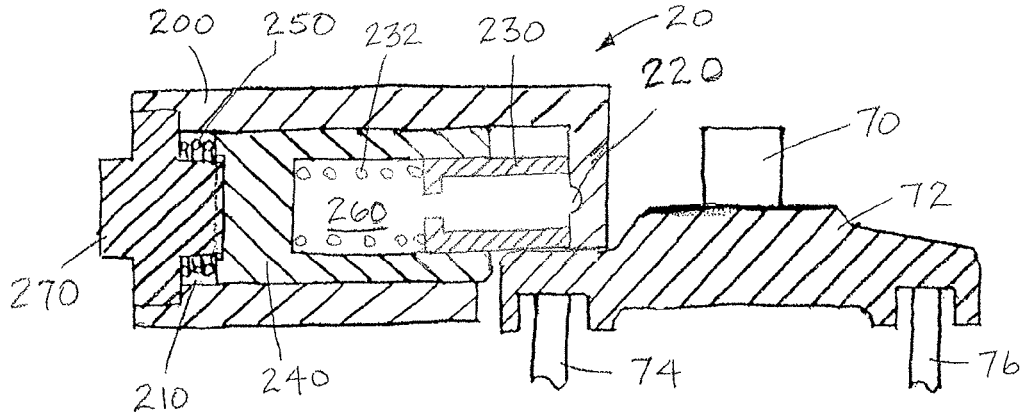
FIG. 3 is a side view in cross-section illustrating the system shown in FIG. 2 when the system is permitting the engine valve to close.

An engine valve actuation system 20 constructed in accordance with a second embodiment of the present invention is illustrated by FIGS. 2 and 3. With reference to FIG. 2, the system 20 may include a housing 200 mounted in an engine above one side of a valve bridge 72. The valve bridge may be used to actuate engine valves 74 and 76, which are preferably exhaust valves, and which are mounted in an engine cylinder head 78. The valve bridge 72 may be "floating," meaning that it may receive a downward motion on only one end to open only one engine valve 74 and/or receive a downward motion in its center to open both engine valves 74 and 76. A rocker arm 70 may be used to actuate both of the engine valves 74 and 76 by providing a downward motion to the center of the valve bridge 72.

The housing 200 may include a piston bore 210 and a hydraulic fluid supply passage 220. The hydraulic fluid supply passage 220 may be connected to a low pressure fluid source, such as the oil pump (not shown), and may be provided with a continuous supply of hydraulic fluid when the engine is running. An actuator piston 240 may be slidably disposed in the piston bore 210. One or more springs 250 may bias the actuator piston into the piston bore 210 and away from the end cap 270 used to seal the piston bore. The actuator piston 240 may include an interior chamber 260 which is shaped and sized to permit the side wall of the actuator piston to receive a tubular sleeve 230 without undue leakage of hydraulic fluid from the chamber 260. The sleeve 230 may be biased by a spring 232 toward the closed end of the piston bore 210. The bias force of the one or more springs 250 may be greater than the bias force of the spring 232 so that the system assumes the position shown in FIG. 2 when hydraulic pressure is released from the interior chamber 260.

The embodiment shown in FIGS. 2 and 3 may provide cylinder decompression during engine start-up by holding open the exhaust valve 74 through horizontal movement of the actuator piston 240. With reference to FIG. 2, when the engine is shut off, hydraulic pressure is decreased in the fluid supply passage 220. As a result, the actuator piston 240 is translated towards the fluid supply passage 220 under the influence of the one or more springs 250. As the actuator piston 240 moves toward the right, its lower surface engages the valve bridge 72 below it and forces the valve bridge downward, which in turn cracks open the exhaust valve 74. At the same time, the sleeve 230 is fully received in the actuator piston 240 which causes the spring 232 to compress. In this manner, the lower surface of the actuator piston 240 acts as a means for causing the exhaust valve 74 to be actuated. Preferably, this downward translation may be about 2 mm for decompression for engine start-up, however the invention is not limited by the amount of downward translation. The actuator piston 240 remains in the position shown in FIG. 2 while the engine is off. As a result, the exhaust valve 74 is open at the time engine start-up is next attempted.

With reference to FIG. 3, when the engine is started, hydraulic fluid is not initially provided to the fluid supply passage 220. It may take until near the time or after the engine is running for sufficient hydraulic fluid pressure to build in the fluid supply passage 220 and the interior chamber 260 to move the actuator piston 240 into the piston bore 210 against the bias of the one or more springs 250. The lateral movement of the actuator piston 240 towards the end cap 270 causes the lower surface of the actuator piston to disengage the valve bridge 72. At the same time, the bias of the spring 232 maintains the sleeve 230 in position against the end wall of the interior chamber 260. The sleeve 230 may prevent undue leakage of hydraulic fluid from the interior chamber. In turn, the valve bridge 72 is free to move upward under the influence of the exhaust valve springs (not shown) and the exhaust valve 74 may close. Thereafter, the exhaust valves 74 and 76 may be opened and closed under the influence of the rocker arm 70 and/or other valve train elements.

The embodiment shown in FIGS. 2 and 3 may also provide bleeder type engine braking during engine operation by holding open the exhaust valve 74 through horizontal movement of the actuator piston 240, as described above. In order to provide engine braking, the fluid supply passage 220 may be connected to an optional solenoid or other type of control valve which can selectively maintain or vent hydraulic pressure from the fluid supply passage in response to an electrical signal. When engine braking is desired during engine operation, fuel flow to the engine cylinder is ceased and hydraulic pressure is decreased in the fluid supply passage 220 under the control of the control valve. As a result, the actuator piston 240 lower surface may engage the valve bridge 72 below it and force the valve bridge downward, which in turn cracks open the exhaust valve 74 for bleeder type engine braking. When bleeder braking is no longer desired, the control valve may supply hydraulic fluid to the interior chamber 260 so that the actuator piston 240 disengages the valve bridge 72 and the exhaust valve 74 closes, as shown in FIG. 3.

Figure 4:
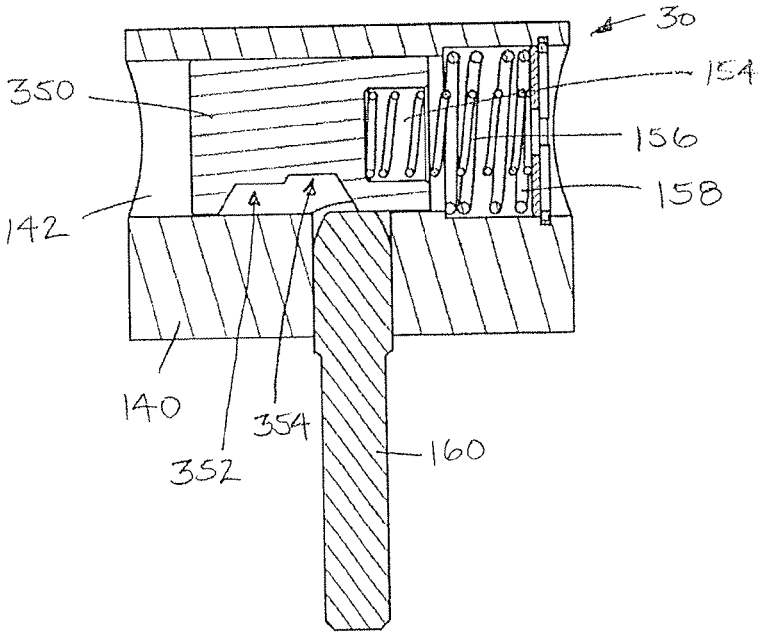
FIG. 4 is a side view in cross-section illustrating a system for providing engine braking and engine decompression for engine start-up in accordance with a third embodiment of the present invention.

A third embodiment of the present invention is illustrated in FIG. 4, in which like reference characters refer to like elements. FIG. 4 illustrates a portion of the outer piston 140 shown in FIG. 1 with an alternative inner piston assembly. All features of the system 30 shown in FIG. 4 are the same as those for system 10 shown in FIG. 1 except for the inner piston assembly and the extension of the inner piston bore 142 through the outer piston 140 and the housing 100. With reference to FIG. 4, the inner piston 350 is biased towards the fluid supply passage (not shown on the left) by a first inner piston spring 156 and a second inner piston spring 158. The inner piston 350 is also provided with a recessed surface including a first annular recess 352 and a second annular recess 354 of different depths. A solenoid or other type of control valve 170 may be connected to the fluid supply passage 120, as shown in FIG. 1.

With reference to FIGS. 1 and 4, the system 30 may provide engine cylinder decompression and bleeder type engine braking. When cylinder decompression for engine start-up is desired, the control valve 170 may vent hydraulic pressure from the fluid supply passage 120 so that the first inner piston spring 156 forces the inner piston 350 into the position shown in FIG. 4. In turn, this forces the sliding pin 160 downward, so that it can crack open one or more exhaust valves for cylinder decompression as described in connection with FIG. 1.

If neither cylinder decompression nor bleeder braking is desired, the control valve 170 may be controlled to provide low pressure hydraulic fluid to the fluid supply passage 120. This causes the inner piston 350 to translate towards the inner piston springs 156 and 158. The low pressure hydraulic fluid may be sufficient to overcome the bias of the first inner piston spring 156, but not sufficient to overcome the bias of the second inner piston spring 158. As a result, application of low pressure hydraulic fluid to the inner piston 350 causes it to move only enough so that the upper surface of the sliding pin 160 is received in the second annular recess 354. This position places the sliding pin 160 in its upper most position, which causes the exhaust valve being actuated by the sliding pin to close.

With continued reference to FIGS. 1 and 4, if bleeder braking is desired, the control valve 170 may be controlled to provide higher pressure hydraulic fluid to the fluid supply passage 120. This causes the inner piston 350 to translate further towards the inner piston springs 156 and 158. The higher pressure hydraulic fluid may be sufficient to overcome the biases of the first inner piston spring 156 and the second inner piston spring 158. As a result of application of higher pressure hydraulic fluid to the inner piston 350, it moves far enough towards the first and second springs 156 and 158 that the upper surface of the sliding pin 160 is received in the first annular recess 352. This position places the sliding pin 160 in an intermediary position, which causes the exhaust valve to be actuated by the sliding pin for bleeder braking, i.e., to a lesser extent than for cylinder decompression.

Figure 5:
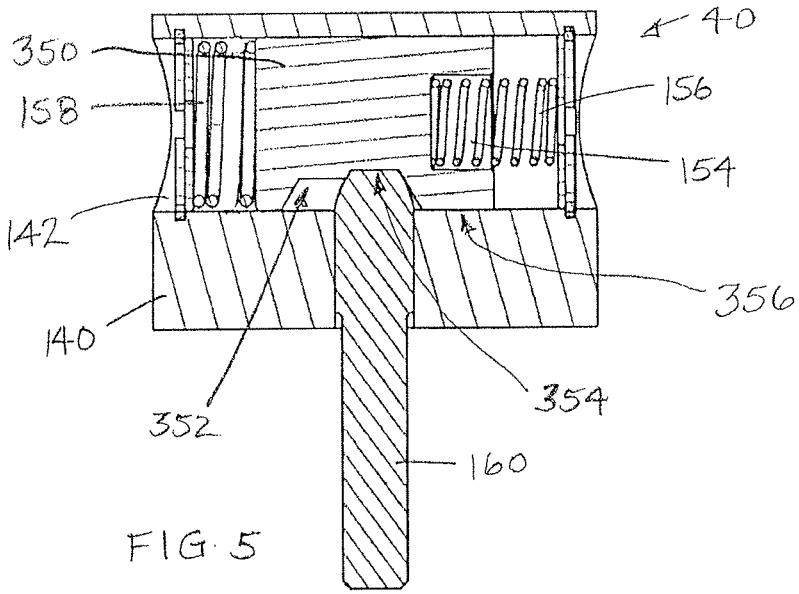
FIG. 5 is a side view in cross-section illustrating a system for providing engine braking and engine decompression for engine start-up in accordance with a fourth embodiment of the present invention.

A fourth embodiment of the present invention is illustrated in FIG. 5, in which like reference characters refer to like elements. FIG. 5 illustrates a portion of the vertically moveable outer piston 140 shown in FIG. 1 with an alternative horizontally moveable inner piston assembly. All features of the system 40 shown in FIG. 5 are the same as those for system 10 shown in FIG. 1 except for the inner piston assembly and the extension of the inner piston bore 142 through the outer piston 140 and the housing 100. With reference to FIG. 5, the inner piston 350 is biased towards the fluid supply passage (not shown on the left) by a first inner piston spring 156. Conversely, the inner piston 350 is biased towards the first inner piston spring 156 by a second inner piston spring 158. The inner piston 350 is also provided with a first annular recess 352 and a second annular recess 354 of different depths. A solenoid or other type of control valve 170 may be connected to the fluid supply passage 120, as shown in FIG. 1.

With reference to FIGS. 1 and 5, the system 40 may provide engine cylinder decompression and bleeder type engine braking. When cylinder decompression for engine start-up is desired, the control valve 170 may vent hydraulic pressure from the fluid supply passage 120 so that the first inner piston spring 156 forces the inner piston 350 into its left-most position so that the sliding pin 160 is forced down by the surface 356 of the inner piston. When the sliding pin 160 is in this position it cracks open one or more exhaust valves for cylinder decompression as described in connection with FIG. 1.

If neither cylinder decompression nor bleeder braking is desired, the control valve 170 may be controlled to provide low pressure hydraulic fluid to the fluid supply passage 120. This causes the inner piston 350 to translate toward and slightly compress the first inner piston spring 156. The second inner piston spring 158 may assist in compressing the first inner piston spring 156. The combination of the low pressure hydraulic fluid and the bias of the second inner piston spring may be sufficient to overcome the bias of the first inner piston spring 156. As a result, application of low pressure hydraulic fluid to the inner piston 350 causes it to move only enough so that the upper surface of the sliding pin 160 is received in the second annular recess 354, as shown in FIG. 5. This position places the sliding pin 160 in its upper most position, which causes the exhaust valve being actuated by the sliding pin to close.

With continued reference to FIGS. 1 and 5, if bleeder braking is desired, the control valve 170 may be controlled to provide higher pressure hydraulic fluid to the fluid supply passage 120. This causes the inner piston 350 to translate further toward and further compress the inner piston spring 156. The higher pressure hydraulic fluid may be sufficient to overcome the bias of the first inner piston spring 156 with the assistance of the second inner piston spring 158. As a result of application of higher pressure hydraulic fluid to the inner piston 350, it moves far enough towards the first and inner piston spring 156 that the upper surface of the sliding pin 160 is received in the first annular recess 352. This position places the sliding pin 160 in an intermediary position, which causes the exhaust valve to be actuated by the sliding pin for bleeder braking, i.e., to a lesser extent than for cylinder decompression.

Figure 6:
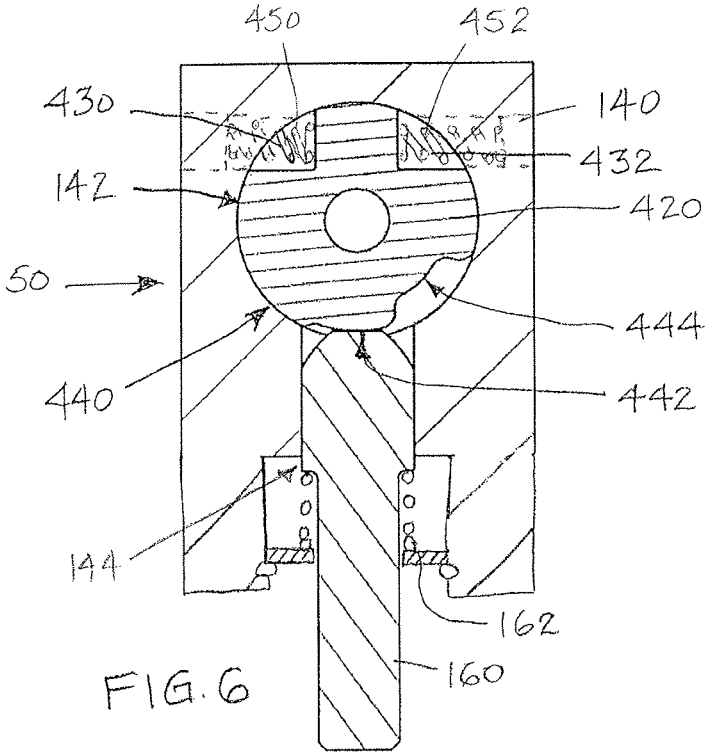
FIG. 6 is a side view in cross-section illustrating a system for providing engine braking and engine decompression for engine start-up in accordance with a fifth embodiment of the present invention.

A fifth embodiment of the present invention is illustrated in FIG. 6, in which like reference characters refer to like elements. FIG. 6 illustrates a system 50 for providing engine valve actuation. The system 50 may include a vertically moveable outer piston 140 in which a inner piston bore 142 is provided. The outer piston 140 may be disposed in an outer piston bore provided in a housing, such as housing 100 shown in FIG. 1, so as to be vertically moveable. The inner piston bore 142 may receive a horizontally disposed inner piston 420 which includes an outer surface 440, first and second notches 430 and 432, and first and second recesses 442 and 444 which form a recessed surface. A sliding pin bore 144 may be provided in the outer piston 140, and a sliding pin 160 may be provided in the sliding pin bore. A sliding pin spring 162 may bias the sliding pin into contact with the inner piston 420.

First and second springs 450 and 452 may be compressed against the flat surfaces of the first and second notches 430 and 432 to maintain the inner piston 420 in the position shown in FIG. 6. The inner piston 420 may be rotated clockwise and counter-clockwise, i.e., may be moveable, relative to the inner piston bore 142 using any known mechanical, hydraulic, electro-mechanical, hydro-mechanical, or the like mechanism. Rotation of the inner piston 420 clockwise causes the sliding pin 160 to be received in the second recess 444 which permits the engine valve (not shown) that is actuated by the sliding pin to close. Rotation of the inner piston 420 counter-clockwise causes the sliding pin 160 to ride up on the surface 440 and to open the engine valve. For example, when the sliding pin 160 is pushed down by surface 440, an exhaust valve or exhaust valve bridge may be depressed by the sliding pin to provide cylinder decompression. When the piston 420 is not rotated one way or the other, as shown in FIG. 6, the sliding pin 160 may be slightly depressed by the first recess 442 to open the engine valve to a lesser degree. If the engine valve is an exhaust valve, this position may place the sliding pin 160 in an intermediary position, which causes the exhaust valve to be actuated by the sliding pin for bleeder braking.

Figure 7:
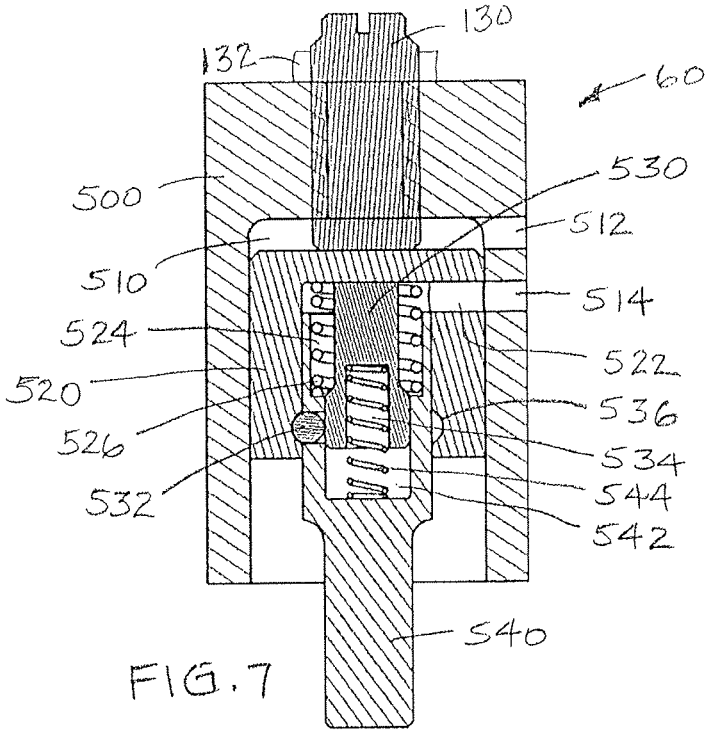
FIG. 7 is a side view in cross-section illustrating a system for providing engine braking and engine decompression for engine start-up in accordance with a sixth embodiment of the present invention.

A sixth embodiment of the present invention is illustrated by FIG. 7, in which like reference characters refer to like elements. FIG. 7 illustrates a system 60 for providing engine valve actuation. The system 60 may include a housing 500 mounted in an engine above a rocker arm, valve bridge or other valve train element (not shown). The housing 500 may include an outer piston bore 510 and a first hydraulic fluid supply passage 512 communicating with the outer piston bore. A first control valve, as shown in FIG. 1, or master piston may communicate hydraulically with the first hydraulic fluid supply passage 512. A lash adjusting screw 130 may extend through the housing 100 into the outer piston bore 510. A nut 132 may be used to lock the lash adjusting screw in place.

Figure 8:
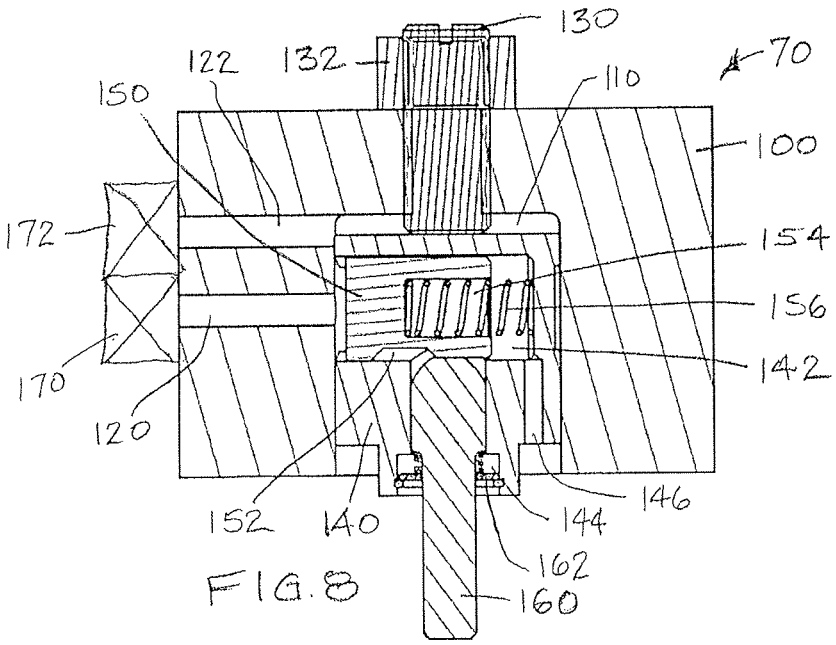
FIG. 8 is a side view in cross-section illustrating a system for providing engine braking and engine decompression for engine start-up in accordance with a seventh embodiment of the present invention.

An outer piston 520 may be slidably disposed in the outer piston bore 510. The outer piston 520 may include an inner piston bore 524 which extends vertically into the outer piston so as to be co-axial with the outer piston bore 510. The inner piston bore 524 communicates with a second fluid supply passage 514 via passage 522. A second control valve, as shown in FIG. 8, may communicate with the second hydraulic fluid supply passage 514. The outer piston 520 may act as a vertically moveable member or "housing" itself for the inner piston disposed in the inner piston bore 524. The second hydraulic fluid supply passage 514 may communicate with a second control valve or master piston assembly (not shown). One or more recesses 536 may be provided in the wall of the outer piston 520.

An inner piston 540 may be slidably disposed in the inner piston bore 524. The inner piston 540 may have a hollow interior 542 defined by the upper portion of the inner piston wall. The hollow interior 542 may be stepped so as to form a shoulder upon which a first spring 526 may exert a biasing force to separate the inner piston 540 from the outer piston 520. The inner piston wall may also include one or more openings sized to receive a ball or roller 532, each of which is sized, in turn, to be received securely in the one or more recesses 536 provided in the wall of the outer piston 520, as shown in FIG. 7. The inner piston 540 may include a lower portion adapted to actuate a rocker arm, valve bridge, or other valve train element, which in turn may actuate an engine valve.

A locking piston 530 may be slidably disposed in the hollow interior 542 of the inner piston 540. The locking piston 530 may include a central opening 534 in which to receive a second spring 544. The second spring may bias the inner piston 540 and the locking piston 530, apart. The diameter of the locking piston 530 at a lower portion may be substantially equivalent to the diameter of the hollow interior 542 of the inner piston 540. The upper portion of the locking piston 530 may have a reduced diameter. The difference between the radius of the lower portion of the locking piston 530 and the radius of the upper portion of the locking piston is at least equal or greater than the depth of the one or more recesses 536.

The embodiment shown in FIG. 7 may provide cylinder decompression during engine start-up by holding open one or more exhaust valves (not shown) through vertical movement of the inner piston 540. When the engine is shut off, hydraulic pressure is decreased in the second hydraulic fluid supply passage 514 under control of the second control valve. As a result, the inner piston 540 is translated downward under the influence of the first spring 526 and the locking piston 530 is translated upward under the influence of the second spring 544. As the inner piston 540 moves downward and the locking piston 530 moves upward, each of the balls or rollers 532 are pushed through its respective opening in the inner piston wall and into the one or more mating recesses 536. The insertion of the balls or rollers 532 into the one or more recesses 536 locks the inner piston 540 into the position shown in FIG. 7 relative to the outer piston 510. While in this position, the inner piston 540 causes the rocker arm or valve bridge below it to be depressed downward, which in turn cracks open one or more exhaust valves. Preferably, this downward translation may be about 2 mm for decompression at start-up, however the invention is not limited by the amount of downward translation. The inner piston 540 remains in the position shown in FIG. 7 while the engine is off. As a result, one or more exhaust valves are open at the time engine start-up is next attempted.

When the engine is started, the second control valve may be opened to supply hydraulic fluid, however hydraulic fluid initially may not be provided to the second fluid supply passage 514. It may take until near the time or after the engine is running for sufficient hydraulic fluid pressure to build in the second fluid supply passage 514 to move the locking piston 530 into the hollow interior 542 of the inner piston 540 against the bias of the second spring 544. The downward movement of the locking piston 530 into the hollow interior 542 permits the balls or rollers 532 to be accommodated by the reduced diameter upper portion of the locking piston and to thereby move out of the one or more recesses 536. As a result, the inner piston 540 may become unlocked from the outer piston 520, and the inner piston 540 may be pushed upward by the exhaust valve springs through an intervening rocker arm or valve bridge. Thereafter, the exhaust valves may be opened and closed under the influence of other valve train elements.

The embodiment shown in FIG. 7 may also provide bleeder type engine braking during engine operation by holding open one or more exhaust valves by locking the inner piston 540 as described above under the control of the second control valve.

The embodiment shown in FIG. 7 may also be used to provide compression release or bleeder engine braking in another manner. Compression release engine braking may be provided by supplying high pressure hydraulic first hydraulic fluid supply passage 512 from either a high pressure reservoir under the control of the optional first control valve or a master piston assembly (shown as element 172 in FIG. 8). The high pressure fluid may be cyclically provided to the outer piston bore 510 when the piston in the engine cylinder underlying the system 60 is near top dead center. The high pressure fluid may be released as the piston moves away from top dead center position, so that the outer piston 520 are forced downward for a compression release engine braking event. The engine valve springs (not shown) may return the outer piston 520 to the position shown in FIG. 7 after each compression release event.

With continued reference to FIG. 7, for bleeder engine braking, low pressure hydraulic fluid may be provided to the first hydraulic fluid supply passage 512 under the control of the optional second control valve so that the outer piston 520 and inner piston 540 are forced downward together for a bleeder braking event. The low pressure fluid may be released when bleeder braking is no longer desired and the engine valve springs (not shown) may return the outer piston 520 to the position shown in FIG. 7.

A seventh embodiment of the present invention is illustrated as the engine valve actuation system 70 in FIG. 8 of the accompanying drawings. The valve actuation system 70 shown in FIG. 8 is identical to the system 10 shown in FIG. 1, with the following exceptions. The system 70 includes a second hydraulic fluid supply passage 122 extending from a second control valve or master piston assembly 172 to the outer piston bore 110.

The system 70 may provide all of the engine valve actuations described above in connection with FIG. 1, and also provide compression release or bleeder engine braking. Compression release or bleeder engine braking may be provided by supplying low pressure hydraulic fluid to the inner piston bore 142 from the fluid supply passage 120. This may cause the inner piston 150 to move into the inner piston bore 142 against the bias of the inner piston spring 156. The lateral movement of the inner piston 150 into its bore 142 causes the annular recess 152 to register with the upper portion of the sliding pin 160. When the inner piston 150 is moved fully to the right, the upper portion of the sliding pin 160 is received within the annular recess 152, and as a result, the sliding pin translates upward under the influence of the pin spring 162.

With continued reference to FIG. 8, for compression release engine braking, high pressure hydraulic fluid may be provided to the second hydraulic fluid supply passage 122 from either a high pressure reservoir under the control of the optional second control valve or a master piston assembly 172. The high pressure fluid may be cyclically provided to the outer piston bore 110 when the piston in the engine cylinder underlying the sliding pin 160 is near top dead center. The high pressure fluid may be released as the piston moves away from top dead center position, so that the outer piston 140 and the sliding pin 160 are forced downward for a compression release engine braking event. The engine valve springs (not shown) may return the outer piston 140 to the position shown in FIG. 8 after each compression release event.

For bleeder engine braking, low pressure hydraulic fluid may be provided to the second hydraulic fluid supply passage 122 under the control of the optional second control valve 172 so that the outer piston 140 and the sliding pin 160 are forced downward for a bleeder braking event. The low pressure fluid may be released when bleeder braking is no longer desired and the engine valve springs (not shown) may return the outer piston 140 to the position shown in FIG. 8.

Figure 9:
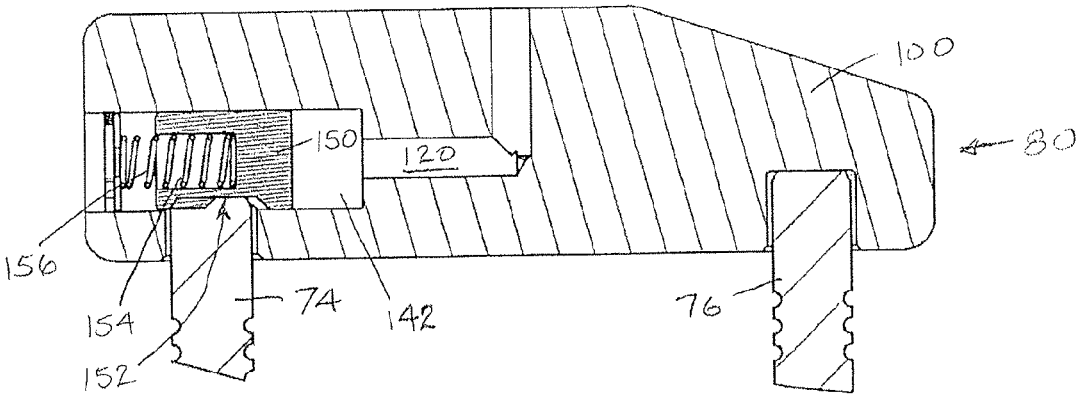
FIG. 9 is a side view in cross-section illustrating a system for providing engine braking and engine decompression for engine start-up in accordance with an eighth embodiment of the present invention.

An eighth embodiment of the present invention is illustrated as the engine valve actuation system 80 in FIG. 9 of the accompanying drawings. The valve actuation system 80 shown in FIG. 9 is identical to the system 10 shown in FIG. 1, with the following exceptions. The system 80 includes an inner piston bore 142 and an inner piston 150 which are provided in a housing 100 which is also a valve bridge. Further, rather than contacting a sliding pin, the inner piston 150 may act directly on the stem of an engine valve 74. The system 80 may provide all of the engine valve actuations described above in connection with FIG. 1.

Figure 10:
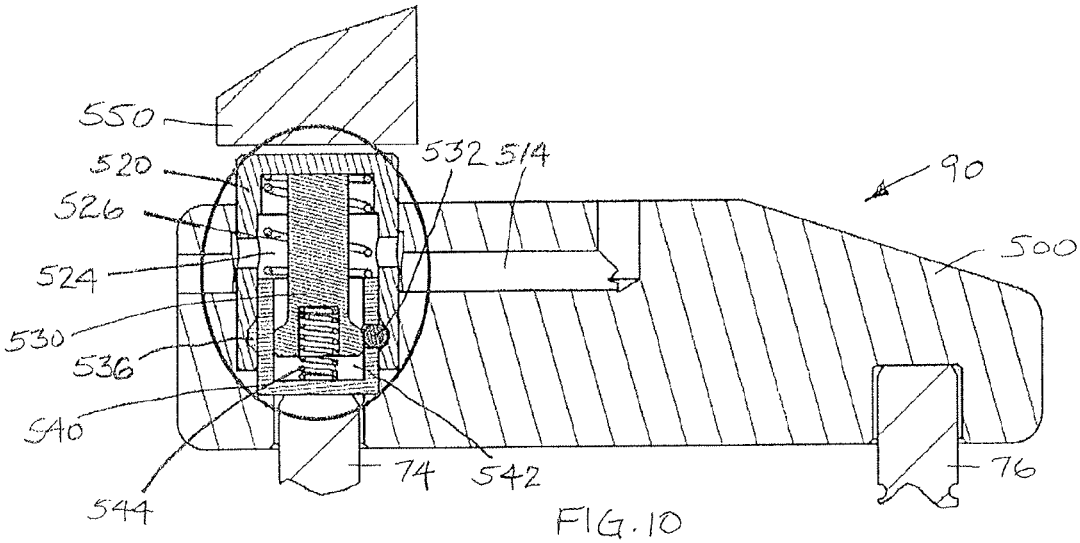
FIG. 10 is a side view in cross-section illustrating a system for providing engine braking and engine decompression for engine start-up in accordance with a ninth embodiment of the present invention.

A ninth embodiment of the present invention is illustrated as the engine valve actuation system 90 in FIG. 10 of the accompanying drawings. The valve actuation system 90 shown in FIG. 10 is identical to the system 60 shown in FIG. 7, with the following exceptions. The system 90 is disposed in a valve bridge which provides the housing 500 for the system. Further, in place of using a first hydraulic fluid supply passage 512 to provide bleeder braking or compression-release braking, another valve train element, such as a rocker arm, cam, slave piston, or other element 550 provides a mechanical engine braking actuation for the outer piston 520. Further, the inner piston 540 may act directly on the stem of an engine valve 74. The system 90 may provide all of the engine valve actuations described above in connection with FIG. 7.

Figure 11:
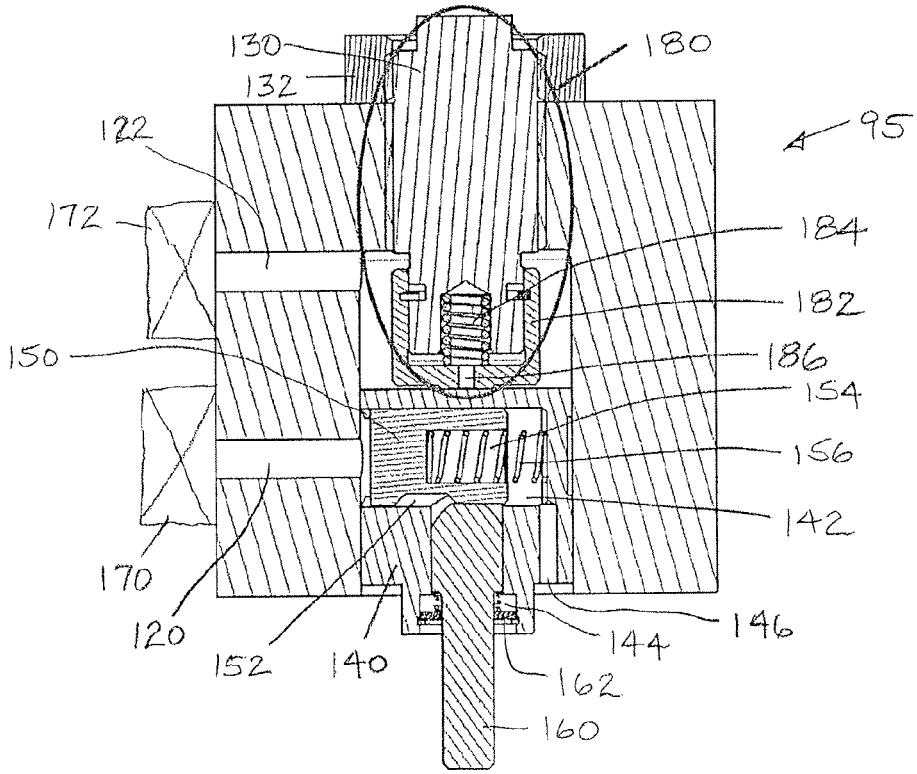
FIG. 11 is a side view in cross-section illustrating a system for providing engine braking and engine decompression for engine start-up in accordance with a tenth embodiment of the present invention.

A tenth embodiment of the present invention is illustrated as the engine valve actuation system 95 in FIG. 11 of the accompanying drawings. The valve actuation system 95 shown in FIG. 11 is identical to the system 70 shown in FIG. 8, with the following exceptions. The system 95 includes a hydraulic lash adjuster assembly 180 which includes a hydraulic lash adjuster piston 182 disposed about the lower end of the lash screw 130, and a lash spring 184 biasing the lash adjuster piston 182 away from the lash screw 130. A small fluid opening 186 may permit hydraulic fluid to fill the interior of the lash adjuster piston 182. The system 95 may provide all of the engine valve actuations described above in connection with FIG. 8.

Figure 12:
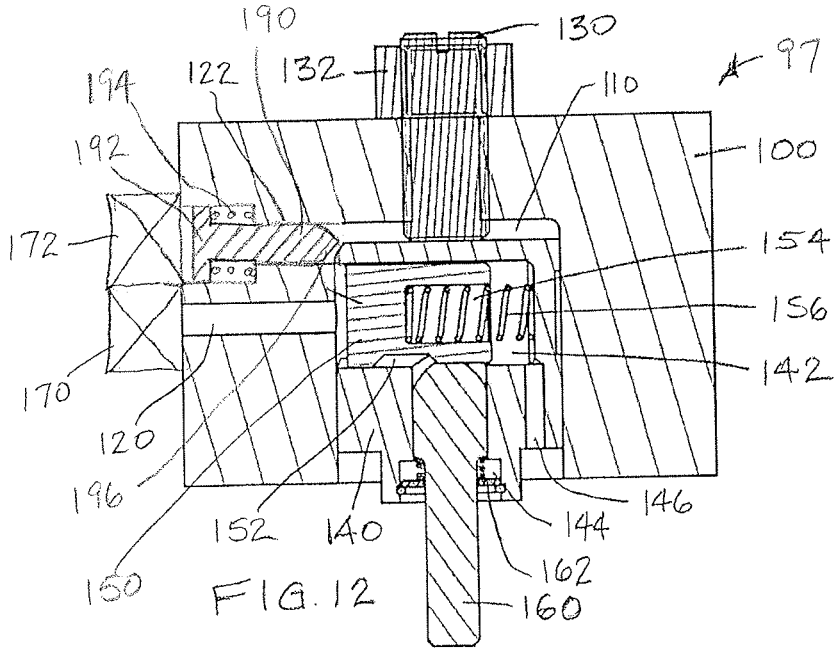
FIG. 12 is a side view in cross-section illustrating a system for providing engine braking and engine decompression for engine start-up in accordance with an eleventh embodiment of the present invention.

An eleventh embodiment of the present invention is illustrated as the engine valve actuation system 97 in FIG. 12 of the accompanying drawings. The valve actuation system 97 shown in FIG. 12 is identical to the system 70 shown in FIG. 8, with the following exceptions. In the system 97, the passage 122 no longer is used to supply hydraulic fluid, but instead receives a sliding member 190. The sliding member may have a generally cylindrical central body, a conical or frusto-conical end 196, and a head portion 192. The passage 122 may have a dual diameter for securely receiving the body of the sliding member and the head portion 192 of the sliding member 190. A spring 194 may be disposed between a shoulder formed by the dual diameter passage 122 and the sliding member head portion 192 so as to bias the sliding member 190 away from the outer piston 140.

In a first example, for bleeder engine braking, low pressure hydraulic fluid may be provided to the passage 122 under the control of the optional second control valve 172 so that the sliding member 190 engages the outer piston 140 and forces the outer piston and the sliding pin 160 downward for a bleeder braking event. The low pressure fluid may be released from the passage 122 by the second control valve 172 when bleeder braking is no longer desired and the spring 194 may cause the sliding member to disengage the outer piston 140 so that the outer piston returns to its upper most position shown in FIG. 12. Alternatively, hydraulic fluid may be provided to the passage 122 under the control of the optional second control valve 172 to provide engine cylinder decompression for engine start up instead of bleeder braking. In all other respects, the system 97 may provide all of the engine valve actuations described above in connection with FIG. 8.

It will be apparent to those skilled in the art that variations and modifications of the present invention can be made without departing from the scope or spirit of the invention. For example, a pneumatic fluid may be used instead of a hydraulic fluid in the above embodiments without departing from the intended scope of the invention. Further, the annular recesses described above are not shown to extend completely around the pistons on which they are provided, however, it is appreciated that these annular recesses could extend around the entire circumference of the pistons without departing from the intended scope of the present invention.

What is claimed is:

1. A system for actuating an engine valve to decompress an engine cylinder or provide engine bleeder braking comprising:

a first vertically moveable member disposed above an engine valve, said vertically moveable member having an inner piston bore extending horizontally into the vertically moveable member;

means for moving the vertically moveable member;

an inner piston provided in the horizontally extending inner piston bore, said inner piston having a recessed surface;

means for moving the inner piston relative to the inner piston bore; and a second vertically moveable member contacting the recessed surface of the inner piston.

2. The system of claim 1, wherein the means for moving the inner piston relative to the inner piston bore comprises a means for moving the inner piston in a horizontal axial direction.

3. The system of claim 1, further comprising:

a first fluid supply passage extending between the means for moving the inner piston and the inner piston bore, wherein the means for moving the inner piston comprises a fluid control valve.

4. The system of claim 1, wherein the means for moving the inner piston relative to the inner piston bore comprises a means for rotating the inner piston within the inner piston bore.

5. The system of claim 1, further comprising:

a housing having an outer piston bore, wherein the first vertically moveable member comprises an outer piston disposed in the outer piston bore.

6. The system of claim 5, further comprising:

a hydraulic lash adjuster assembly extending through the housing into the outer piston bore.

7. The system of claim 1, wherein the first vertically moveable member is a valve bridge.

8. The system of claim 1, wherein the means for moving the first vertically moveable member comprises a lash screw.

9. The system of claim 1 wherein the means for moving the first vertically moveable member comprises a horizontally sliding member.

10. The system of claim 1, further comprising a first spring provided in the inner piston bore, said first spring biasing the inner piston into a predefined position in the inner piston bore.

11. The system of claim 10 further comprising a second spring provided in the inner piston bore, said second spring biasing the inner piston in a direction opposite to that of the first spring.

12. The system of claim 10 further comprising:

an interior bore provided in the inner piston, wherein the first spring extends into the interior bore.

13. The system of claim 10, wherein said inner piston bore has a larger diameter portion and a smaller diameter portion, wherein the system further comprises a second spring disposed in the larger diameter portion of the inner piston bore, and wherein the second spring biases the inner piston in the same direction as the first spring.

14. The system of claim 1, further comprising:

a vertically oriented sliding pin bore extending through a lower portion of the inner piston to the inner piston bore, wherein the second vertically moveable member comprises a sliding pin disposed in the sliding pin bore.

15. The system of claim 1, wherein the second vertically moveable member comprises an engine valve stem.

16. The system of claim 1, further comprising a spring biasing the second vertically moveable member into contact with the recessed surface of the inner piston.

17. The system of claim 1 wherein the recessed surface of the inner piston includes first and second recesses of different depths.

18. The system of claim 3, further comprising:

a housing having an outer piston bore;

an outer piston disposed in the outer piston bore, wherein the outer piston comprises the first vertically moveable member; and a second fluid supply passage extending between the means for moving the first vertically moveable member and the outer piston bore.

19. The system of claim 18, further comprising a second fluid control valve, wherein the second fluid control valve comprises the means for moving the first vertically moveable member.

20. The system of claim 18, further comprising a master piston assembly in hydraulic communication with the second fluid supply passage.

21. The system of claim 18, further comprising:

a hydraulic lash adjuster assembly extending through the housing into the outer piston bore.

22. A system for actuating an engine valve to decompress an engine cylinder or provide engine bleeder braking comprising:

housing mounted in an engine above one side of a valve bridge;

a piston bore extending horizontally into the housing;

a hydraulic fluid supply passage communicating with the piston bore;

an actuator piston disposed in the piston bore, said actuator piston having an interior chamber with an end wall;

a spring biasing the actuator piston into the piston bore in a direction which causes the actuator piston to engage an underlying engine valve bridge;

a sleeve disposed in the interior chamber; and a spring biasing the sleeve away from the interior chamber end wall.

23. A system for actuating an engine valve to decompress an engine cylinder comprising:

a housing having an outer piston bore extending vertically into the housing, and a first fluid supply passage extending through the housing to the outer piston bore;

an outer piston disposed in the outer piston bore, said outer piston having an inner piston bore extending vertically into the outer piston and having a fluid passage extending through the outer piston to the inner piston bore, wherein said fluid passage is located to register with the first fluid supply passage;

one or more recesses formed along the outer piston bore; means for moving the outer piston;

an inner piston provided in the inner piston bore, said inner piston having a hollow interior defined by an inner piston wall, wherein an interior surface of the inner piston wall is stepped to form a shoulder;

one or more openings provided in the inner piston wall, said one or more openings adapted to register with the one or more recesses formed along the outer piston bore;

a first spring provided in the outer piston bore between an upper end of the outer piston and the inner piston shoulder;

a locking piston disposed in the inner piston hollow interior;

a spring provided in the inner piston hollow interior between the inner piston and the locking piston; and a ball or roller disposed in the one or more openings provided in the inner piston wall, said ball or roller further disposed between the locking piston and the outer piston.

24. The system of claim 23, wherein a valve bridge comprises the housing.

25. The system of claim 24, wherein a rocker arm comprises the means for moving the outer piston.

26. The system of claim 23, wherein a lash adjustment screw comprises the means for moving the outer piston.

27. The system of claim 23, further comprising:

a second fluid supply passage extending through the housing to the outer piston bore.

* * * * *

UNITED STATES PATENT AND TRADEMARK OFFICE

CERTIFICATE OF CORRECTION

PATENT NO. : 8,863,726 B2
APPLICATION NO. : 13/624478
DATED : October 21, 2014
INVENTOR(S) : Brian Ruggiero et al.

It is certified that error appears in the above-identified patent and that said Letters Patent is hereby corrected as shown below:

On the title page, item (72) the inventor listed as "Joseph Paturzo" should read "Joseph Paturzo III"

Signed and Sealed this
Third Day of February, 2015

Michelle K. Lee

Michelle K. Lee
*Deputy Director of the United States Patent and Trademark Office*